United States Patent [19]

Mista

[11] 4,385,506

[45] May 31, 1983

[54] WEFT THREAD LAYING APPARATUS WITH TENSION STRIP

[75] Inventor: Kresimir Mista, Obertshausen, Fed. Rep. of Germany

[73] Assignee: Karl Mayer Testilmaschinenfabrk GmbH, Fed. Rep. of Germany

[21] Appl. No.: 217,902

[22] Filed: Dec. 18, 1980

[30] Foreign Application Priority Data

Dec. 21, 1979 [DE] Fed. Rep. of Germany ..... 2951643

[51] Int. Cl.[3] ..... D04B 23/06

[52] U.S. Cl. ..... 66/84 A

[58] Field of Search ..... 66/84 A, 85 A, 125; 28/1 CL

[56] References Cited

U.S. PATENT DOCUMENTS 3,665,732 5/1972 Doring et al. ..... 66/84 A 3,771,330 11/1973 Carman ..... 66/84 A 3,953,989 5/1976 Politze et al. ..... 66/84 A

*Primary Examiner*—Ronald Feldbaum

*Attorney, Agent, or Firm*—Omri M. Behr

[57] ABSTRACT

A weft thread laying apparatus for warp knitting machines includes a carriage with a thread guide slidably disposed therein. The carriage moves perpendicular to a pair of endless transfer chains which carry the weft thread in a longitudinal direction from a pick up area to a delivery area proximate the needle bed of the machine. The thread guide is moved in a longitudinal direction by means of a flexible guide band when the carriage is disposed in the vicinity of the endless transfer chains thereby permitting the thread guide to layer a plurality of threads around holding elements disposed on the transfer chain without requiring the carriage to move in more than one plane. The flexible guide band is moved with a cam and linkage arrangement only when the carriage is proximate the transfer chains.

7 Claims, 4 Drawing Figures

WEFT THREAD LAYING APPARATUS WITH TENSION STRIP

BACKGROUND OF THE INVENTION

1. Field of the Invention

The present invention relates to weft thread inserting apparatuses, and in particular to a weft thread apparatus for warp knitting machines which moves only transverse to the transfer chains and has a movable thread guide slidably disposed thereon to reduce the mass of the movable elements, thereby permitting the warp knitting machine to operate at accelerated speed.

2. Discussion of the Relevant Art

Many types of weft inserting mechanisms for use with warp knitting machines are known in the art. Typical of these is the one disclosed in U.S. Pat. No. 3,665,732 issued to Wolfgang Doring, et al on May 30, 1972. The apparatus disclosed therein includes a rigid guide rod held in axial bearings at both ends thereof. The rod is driven by means of a chain drive from a common cam plate which runs parallel but oposed to the longitudinal movement of the transfer chains. Two levers are articulated to the rigid guide bar, one on each end, and may be pivoted to the stitch forming point on the machine and back and are held in the forward of position by means of springs. The carriage runs on two rails displaced from each other in the longitudinal direction and is provided with a front and rear end plate connected by rods. The thread carrier which is coupled to the guide rail is provided with a front and rear end plate and has disposed therebetween a plurality of openings which function as thread guide. The thread guide is displacable in a longitudinal direction along the rods disposed between the front and rear plates of the carriage in accordance with the motion imparted thereto by the movement of the rigid guide rod.

Utilizing this type of construction, or other construction similar thereto, substantially restricts the speed at which the machine may be operated, since the mass of the carriage and the thread guide causes tremendous forces when the machine operates at relatively high speeds. If an attempt is made to operate this type of machine at a relatively high speed, the amount of vibration encountered would soon cause the machine to fail. The shortcommings of this type of construction occuring in the art has been overcome with the instant invention by providing a relatively light weight carriage which moves in the transverse direction together with a thread guide of extremely light weight which moves only when proximate the transfer chain while the far end of the guide band is subject to minimal movement, thereby reducing the amount of mass to be moved and the associated vibrational forces accompanied therewith.

SUMMARY OF THE INVENTION

Therefore it is one object of the present invention to provide a carriage and thread guide having minimum mass so that a warp knitting machine utilizing a weft thread laying apparatus of the present design can operate at relatively high speeds.

It is another object of the present invention to provide a flexible guide band to replace the rigid guide bar known heretofore on weft thread laying apparatuses on warp knitting machines.

It is yet another object of the present invention to provide a reliable weft thread laying apparatus capable of operating at high speeds in warp knitting machines.

It is a further object of the present invention to provide a weft thread laying apparatus for warp thread kitting machines that utilizes a flexible guide band which is very inefficient in transfering impact and vibrational forces.

It is yet another object of the present invention to provide a weft thread laying apparatus for a warp knitting machine wherein the logitudinal moving device is rigidly coupled to the thread guide device only when the thread guide device is in the vicinity of the endless transfer chains.

A weft thread laying apparatus for warp knitting machines, according to the principles of the present invention, comprises in combination a pair of endless transfer chains generally disposed perpendicular to the needle bed of the warp knitting machine at proximate the ends thereof for continually carrying the weft threads in a longitudinal direction from a pick-up area to a delivery area proximate the needle bed. Transfer chains are provided with a plurality of holding elements disposed thereon. A carriage is disposed above the pair of transfer chains in the pick-up area and the carriage is movable back and forth perpindicular to the transfer chains. A thread guide is slidably disposed on the carriage for laying a plurality of weft threads about the holding elements disposed on one of the transfer chains and then about the holding elements disposed on the other of the transfer chains in a continuing sequence. Additionally included, is a device for moving the thread guide in the longitudinal direction when the carriage is proximate each of the transfer chains for permitting the weft threads to lay around the holding elements on the transfer chain. The longitudinal moving device includes a flexible guide band extended beyond and generally transversely to the endless transfer chains. The flexible guide band is coupled to the thread guide. A steering device is disposed on either end of the flexible guide band and coupled thereto. A displacement apparatus is coupled to the steering device for displacing the flexible guide band and the thread guide means.

BRIEF DESCRIPTION OF THE DRAWINGS

In order that the invention may be more fully understood, it will now be described, by way of example, with references of the accompanying drawings in which.

DESCRIPTION OF THE PREFERRED EMBODIMENT

Figure 1:
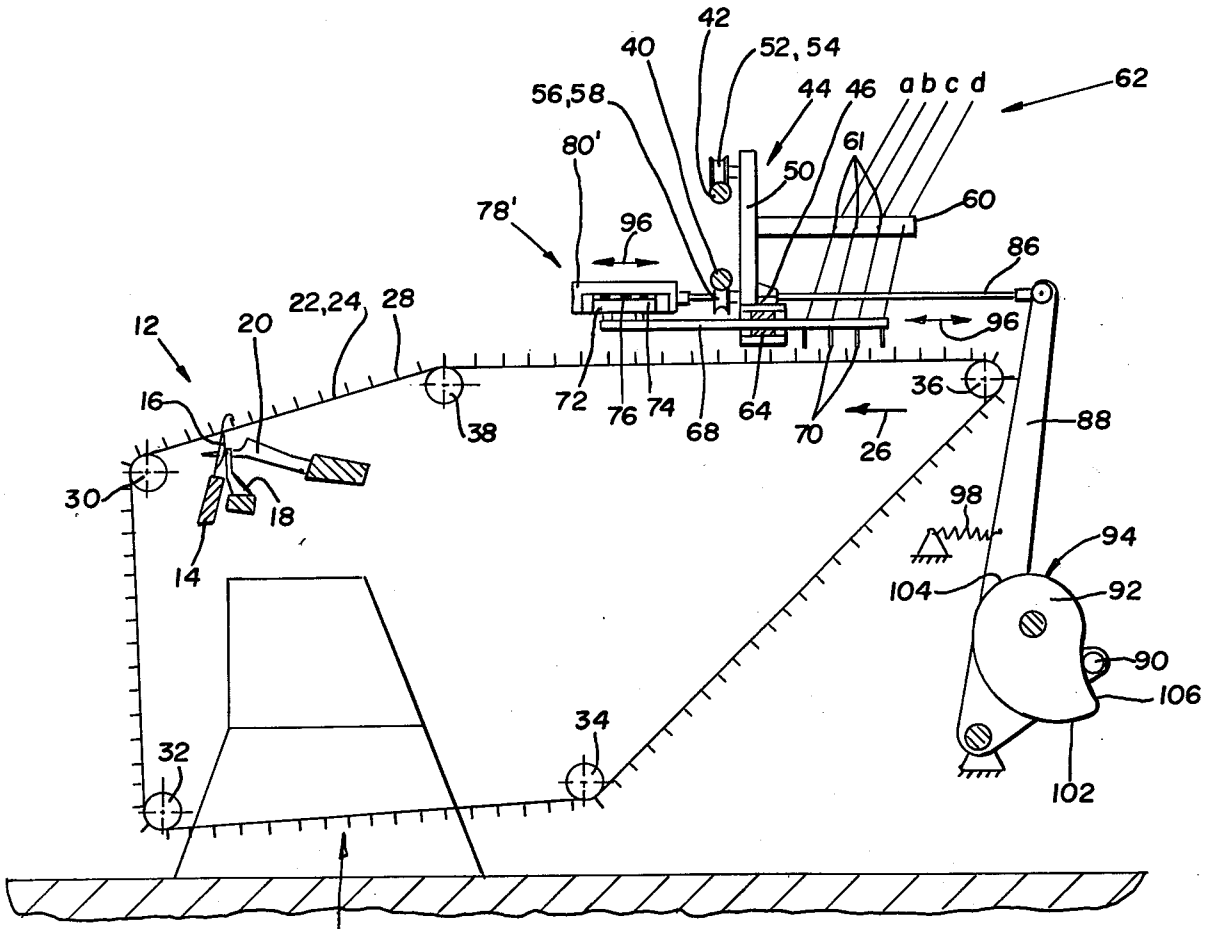
FIG. 1 is a schematic side view, partially in cross section, of a warp knitting machine equipped with the weft thread laying apparatus, according to the principles of the present invention.

Referring now to the figures, and in particular to FIG. 1, which discloses the warp knitting machine 10 of the instant invention. The warp knitting machine 10 includes a needle bed 12 which has a needle bar 14 having a plurality of hook needles 16 disposed thereon in a conventional manner. The needle 16 cooperate with a slider mechanism 18 and a knockover sinker 20 all of which is a conventional design. On both ends of the needle bed 12 there is provided a pair of endless transfer chains 22 and 24 which move in a longitudinal direction as shown by arrows 26 and 26'. The transfer chains are provided with a plurality of holding devices 28 equally spaced and fixed to the transfer chains 22 and 24 in a conventional manner. The holding devices preferably are pawn-like (a sphere disposed upon a truncated cone) and serve to hold the weft thread once it is wrapped therearound.

The transfer chains are endless and are led over a plurality of rollers 30, 32, 34, 36 and 38 of which at least one is connected to a source of driving power, not shown. In the transverse direction (perpendicular to the transfer chains) a pair of support rails 40 and 42 are disposed one above the other. A carriage 44 is driven forward and backward in a conventional manner, by means of a chain 46, belt or the like, as shown by arrow 48 in FIG. 2.

Figure 4:
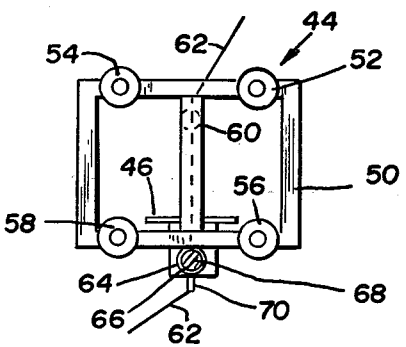

The carriage 44 includes a frame (FIG. 2) and a pair of rollers or wheels 52 and 54 journaled in the upper portion of frame 50, in a conventional manner and a pair of rollers or wheels 56 and 58 as journaled on the lower portion of the frame in the same manner. The rollers 52 and 54 are adapted to ride on the support rail 42 and the rollers 56 and 58 are adapted to ride on the support rail 40 permitting the carriage 44 to move in a transverse direction freely thereon. The carriage 44 is also provided with an upper thread guide 60 which is provided with a plurality of apertures 61 therein through which the weft threads 62 *a,b,c* and *d* are threaded. Preferably, the lower portion of the carriage frame 50 is provided with a bushing 64 having aperture 66 therein which is adapted to slidably receive a guide rod 68 therein (FIG. 4). One end of guide rod 68 is provided with a plurality of thread guides 70 disposed thereon, in a conventional manner and the other end of rod 68 is provided with a pair of rollers 72 and 74 journaled thereon. The rollers 72 and 74 are located on both sides of a flexible guide band 76 preferably made of steel. The guide rod 68 is permitted to freely move within aperture 66 of bushing 64 and its movement thereof is obviously controlled by the position of rollers 72 and 74.

One end of the flexible guide band 76 is preferably rigidly connected to a steering apparatus 78 which is provided with a housing 80 having an opening 82 therein adapted to receive rollers 72 and 74 therein, as well as, retain band 76 by means of a nut 84 provided therefor. The steering apparatus 78 has its housing 80 coupled by means of a rod 86 and lever 88 articulated therewith. The lever 88 is provided with a contact roller 90 journaled thereon which continually cooperates with a driven cam 92 having a curved surface 94 which cooperates with roller 90 thereby moving lever 88 and rod 86 in the direction of arrow 96 which is in the longitudinal direction. A spring 98 maintains tension on lever 88 so that contact roller 90 faithfully follows the surface 94 of cam 92.

Figure 3:
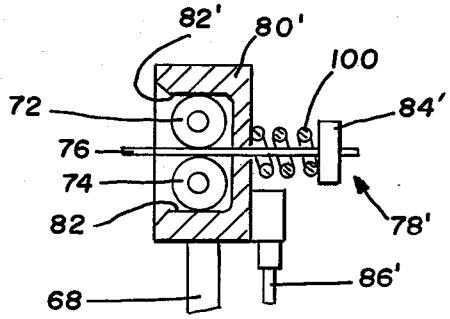
FIG. 3 is a partial view in cross section of the steering device coupled to the thread guide device when located proximate an endless transfer chain of a the warp knitting machine of the insent invention.

On the opposite end of the needle bed proximate transfer chain 22 a second steering apparatus 78' is provided. Steering apparatus 78' includes a housing 80' which is provided with an aperture 82' and is driven in the direction of arrow 96' by rod 86', lever 88' and a contact roller and cam arrangement, not shown, similar to the driving arrangement shown with regard to the steering apparatus 78. The band 76 is retained in the housing 80' by means of nut 84' and is also provided with a spring device 100 disposed between the nut and rear surface of the housing so that by tightening or loosening the nut 84' the tension of the flexible guide band 76 may be adjusted. An enlarged view of the steering apparatus 78' is shown in FIG. 3 with the rollers 72 and 74 disposed therein when the carriage 44 reaches its end of travel and is nested within aperture 82' provided in the housing 80'.

Figure 2:
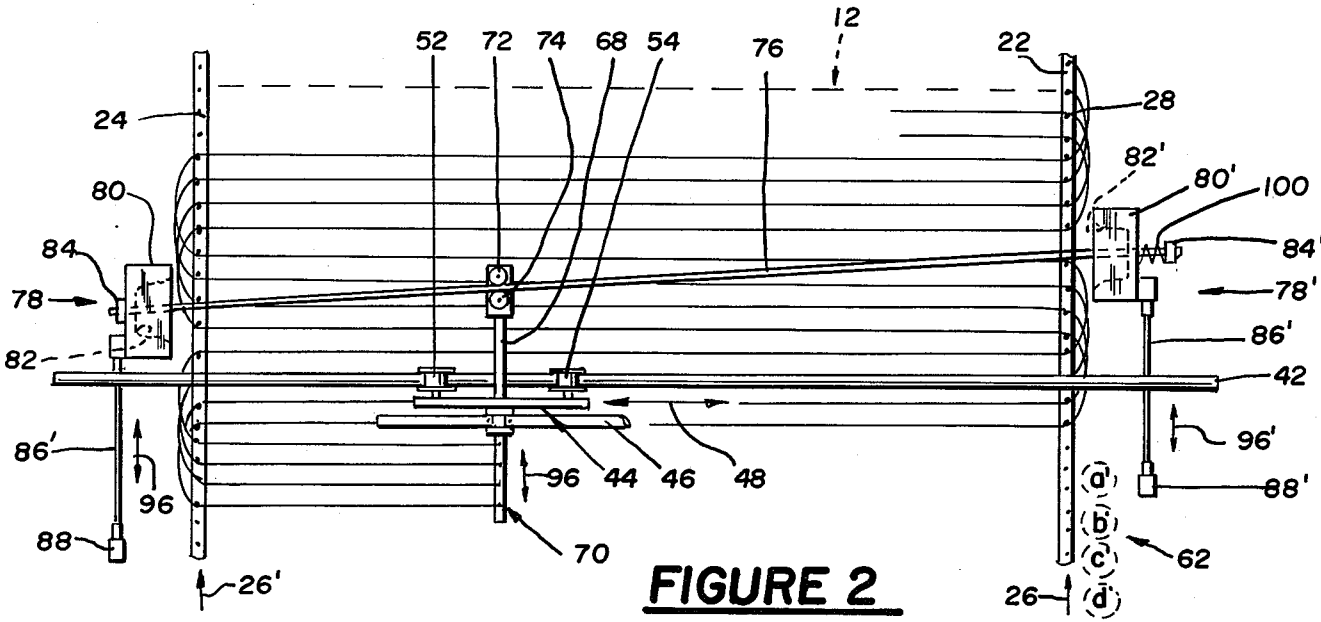
FIG. 2 is a plan view of the needle bed of the machine shown in FIG. 1 from a weft thread pick-up area to the delivery area proximate the needle bed.

As shown in FIGS. 1 and 2 the weft threads 62 *a,b,c* and *d* are taken from spools 62 *a',b',c'*, and d' (see FIG. 2) and threaded through upper thread guide 60 and then through thread guides 70 and by means of the movement of the carriage 44 and guide 70 the weft threads 62 are wrapped around the holding devices 28 on the transfer chains. The weft threads 62 are moved rearwardly in the direction of arrow 96 when they find themselves outside of the transfer chains 22 and 24 and this rearward longidutinal movement is repeated each time the carriage is moved in the area of transfer chain 22 and then in the area of transfer chain 24, as explained hereinafter.

In operation, the transfer chains 22 and 24 are driven in a forward or longitudinal direction as shown by arrows 26 and 26'. The carriage 44 is moved in the direction of arrow 48 by means of a reciprocating drive arrangement 46 whereby it is made to come to rest for a short period of time at the end of travel of the carriage which occurs when rollers 72 and 74 are positioned in the housing 80' where the rearward movement is timed to take place. The carriage is moved in a longitudinal direction as shown by arrow 96 when the steel band 76 is moved backwards and forwards by the steering apparatus which is coupled to cam 92, via rod 86 and via rod 88, as explained earlier. The rearward movment is adjusted to move the thread guides 70 a distance of four holding devices 28 as determined by the cam surface 94 on cam 92. As the carriage 44 starts to move towards the left, as shown in FIG. 2, a small forward movement of thread guide 70 occurs because of the segment 102 of cam 92. This movement comes to a complete halt as the cam portion 104 comes into contact with contact roller 90. All movement essentially comes to a complete halt when segment 104 is in contact with the contact roller 90. This occurs when the carrier 44 is located inside of the transfer chains 22 and 24. When the carriage finds itself outside of the transfer chains 22 and 24 cam segment or portion 106 causes the linkage 86 and 88 to move the thread guide 70 sharply in a rearward direction thereby permitting the thread to move past the holding devices 28 on transfer chains 22 or 24 and the wrap around is completed as the carriage then returns towards the opposite transfer chain.

Other wrap around features may be utilized and interaction with the transfer chains may be timed differently thereby providing the laying of parallel weft threads but also laying of diagonal weft threads. It is also to be noted that although a single rod 68 has been shown to support the thread guide 70 in the instant embodiment of the invention, it is obvious by those knowledgable in the art, that a pair of rods could be utilized to prevent the thread guides 70 from rotating because of thread tension. Likewise a pair of axial bearings 64 can be utilized to accomplish this function.

Hereinbefore has been disclosed a light weight device for installing weft threads in a warp knitting machine capable of operating at relatively high speeds. It will be understood that various changes in the details, materials, arrangement of parts and operating conditions which have been herein described and illustrated in order to explain the nature of the invention maybe made by those skilled in the art within the principles and scope of instant invention.

Having thus set forth the nature of the invention what is claimed is:

1. A weft thread laying apparatus for warp knitting machines comprising, in combination:

(a) a pair of endless transfer chain means generally disposed perpendicular to the needle bed of said warp knitting machine and proximate the ends thereof for continually carrying weft threads in a longitudinal direction from a pick-up area to a delivery area proximate said needle bed, said transfer chains being provided with a plurality of holding elements disposed thereon;

(b) carriage means disposed above said pair of transfer chain means in said pick-up area, said carriage means being movable back and forth perpendicular to said transfer chain means;

(c) thread guide means slidably disposed on said carriage means for laying a plurality of weft threads about said holding elements disposed on one of said pair of transfer chain means and then about the holding elements disposed on the other of said pair of transfer chain means in a continuing sequence; and (d) means for moving said thread guide means in a longitudinal direction when said carriage means is proximate each said transfer chain means for permitting said weft threads to lay around said holding elements on said transfer chain means, said longitudinal moving means including:

(i) a flexible guide band extending beyond and generally transversely to said endless transfer chain means, said flexible guide band being coupled to said thread guide means, (ii) steering means disposed on either end of said flexible guide band and coupled thereto, (iii) displacement means coupled to said steering means for displacing said flexible guide band and said thread guide means, (iiii) said flexible guide band having at least one end thereof retained in said steering means by a spring means for maintaining band tension.

2. A weft thread laying apparatus according to claim 1 wherein said thread guide means is coupled to said flexible guide band by means of a shaft having two rollers dispersed on one end thereof with said band being disposed there between, said shaft being movable in a longitudinal direction relative to said carriage.

3. A weft thread laying apparatus according to claim 2 wherein said rollers are adapted to be received into and cooperate with the housing of said steering means.

4. A weft thread laying apparatus according to claim 1 wherein said steering means includes a housing, said housing being coupled to said displacement means by a push rod and lever cooperating with a cam means for moving said steering means in accordance with a predetermining pattern, said cam means being adapted to be coupled to the source of driving power.

5. A weft thread laying apparatus according to claim 4 wherein said thread guide means is coupled to said flexible guide band by means of a shaft having two rollers disposed on one end thereof with said band being disposed therebetween, said rollers being received into and cooperating with said steering means housing.

6. A weft thread laying apparatus according to claim 1 wherein said means for moving said flexible guide band applies longitudinal motion to said guide band at only one end at a time.

7. A weft thread laying apparatus according to claim 1 wherein said carriage means comprises a generally flat frame with a pair of upper wheels and a pair of lower wheels journaled on said frames, said wheels being adapted to move said carriage along a pair of rails disposed one above the other transverse to said pair of endless transfer chains.

* * * * *